United States Patent [19]

Soley

[11] 4,055,489

[45] Oct. 25, 1977

[54] MAGNETIC SEPARATOR FOR SOLID WASTE

[75] Inventor: Warren G. Soley, Greenfield, Wis.

[73] Assignee: Magnetics International, Inc., Maple Heights, Ohio

[21] Appl. No.: 597,406

[22] Filed: July 21, 1975

[51] Int. Cl.[2] ..... B03C 1/16

[52] U.S. Cl. ..... 209/223 R; 209/223 A; 209/226; 209/231

[58] Field of Search ..... 209/223 R, 223 A, 225, 209/216, 226, 218, 231, 232; 198/290.3; 259/DIG. 46

[56] References Cited

U.S. PATENT DOCUMENTS

| | | | |
|---|---|---|---|
| 404,333 | 5/1889 | Bell | 209/226 |
| 698,311 | 4/1902 | McPhee | 209/225 X |
| 723,362 | 3/1903 | Campbell | 209/223 R X |
| 1,576,690 | 3/1926 | Ullrich | 209/225 X |
| 1,889,349 | 11/1932 | Buitron | 209/223 R |
| 2,470,889 | 5/1949 | Drescher | 209/226 X |
| 2,591,122 | 4/1952 | Blind | 209/225 X |
| 2,692,678 | 10/1954 | Blind | 209/223 R |
| 2,844,251 | 7/1958 | LeRoy | 209/216 |
| 3,489,281 | 1/1970 | St. Pierre | 209/223 R |
| 3,935,947 | 2/1976 | Barrett | 209/223 A X |
| 3,985,647 | 10/1976 | Smith | 209/223 A |

*Primary Examiner*—Robert Halper

*Attorney, Agent, or Firm*—Wegner, Stellman, McCord, Wiles & Wood

[57] ABSTRACT

A magnetic separator is provided with a plurality of successively disposed magnetic field producing members with each successive field being differently oriented so as to agitate the agglomerate of magnetic and non-magnetic materials as said agglomerate is moved from one field producing member to the next. Cleats are used to assist in moving the agglomerate so that as the agglomerate is moved from one field to the next, the magnetics snap, jump or rapidly move so as to drop or release the non-magnetics trapped with the magnetics.

23 Claims, 5 Drawing Figures

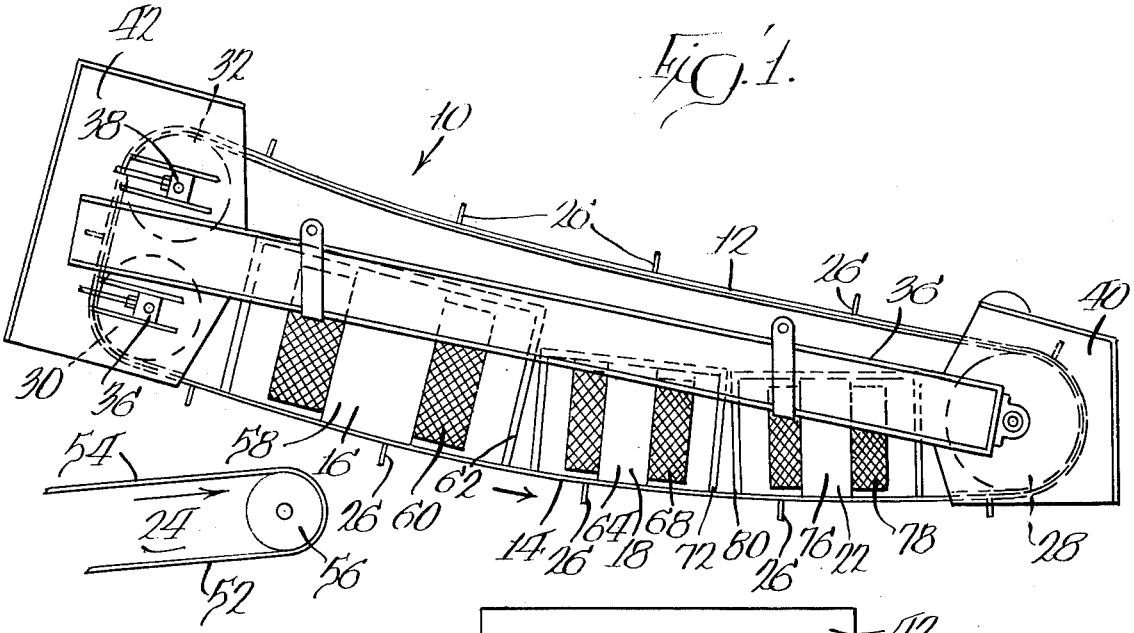
Fig. 1.
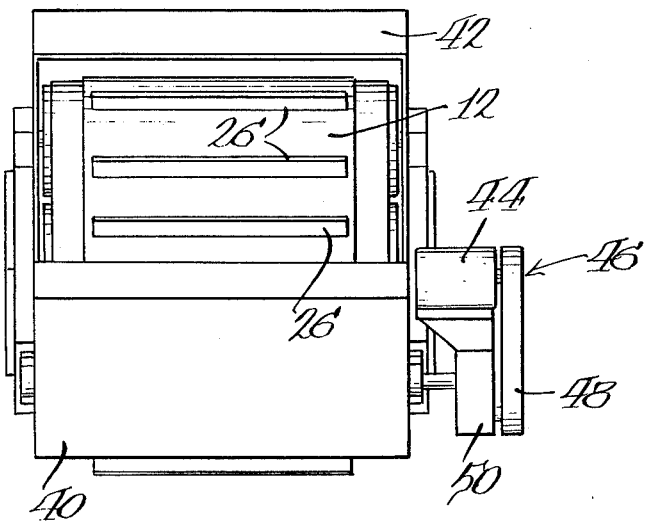
Fig. 2.
Fig. 3.
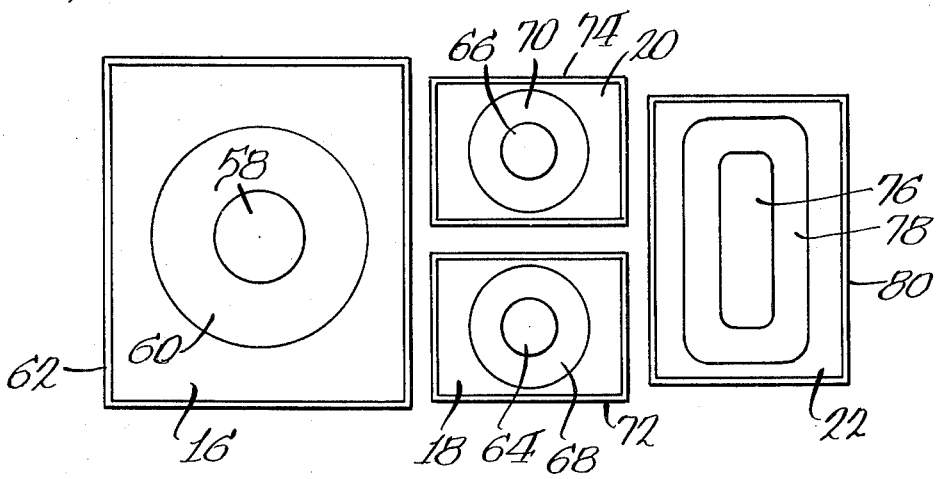

MAGNETIC SEPARATOR FOR SOLID WASTE

BACKGROUND OF THE INVENTION

1. Field of the Invention

This invention relates generally to magnetic separators and, more particularly, to a magnetic separator in which material is caused to be moved through a series of magnetic fields.

2. Description of the Prior Art

It is a common practice today to recycle or reuse any material comprising an article which has reached the end of its useful life. Most often this material consists of metal, glass, plastics, paper, and the like, which are intermixed. Before they can be reused, these materials must be separated into the various components. This is a very time consuming process and any mechanism which tends to decrease the time involved or increase the efficiency of such a process would be desirable.

Metals, especially those which are magnetic, are easily separated from these other materials by employing a magnetic field to attract magnetic metallic material and draw it away from the remainder of material. It is most desirable that this metallic material be free of any other material. This is difficult since non-magnetic material often has a tendency to cling or become entrapped in the magnetic material which is being separated. Separation of magnetic and non-magnetic material is aided if the material is agitated and gyrated so that the non-magnetic is discarded and only the magnetic material is transported to the discharged zone for magnetic material.

SUMMARY OF THE INVENTION

It is the principal object of the present invention to provide a new and improved magnetic separator. More specifically, it is an object of the present invention to provide a separator which is particularly suited for the efficient separation of magnetic and non-magnetic material.

In accordance with the present invention, a new magnetic separator is provided and includes a series of magnets generating a variety of magnetic fields. The magnetic fields are so disposed with respect to one another that the magnetic material is agitated as it moves between the various magnetic fields. The agitation is effected by positioning the magnets laterally and longitudinally within the separator. Hence, magnetic material delivered to the magnetic separator travels longitudinally and partially laterally therein thereby encouraging agitation so as to dislodge any non-magnetic material entrapped with the magnetic material. Magnetic material is thereby rendered free of non-magnetic material which has been discarded as a result of the agitation.

In one embodiment of the invention, the magnetic fields present act along the lower run of a conveyor belt which extends through the magnetic separator and spans all of the magnetic fields being generated so that magnetic material is suspended underneath the lower run. In a second embodiment of the invention, a series of spaced rotatable drums is employed and each of the drums has at least one magnet situated therewithin which attracts magnetic material from the preceding drum in the series.

In an exemplary construction of the first embodiment, the magnets are disposed so that magnetic material suspended underneath the lower run of the conveyor belt moves randomly from one magnetic field to the next magnetic field. The positioning of the magnets causing lateral as well as longitudinal movement of the magnetic material so that magnetic material is agitated thereby dislodging non-magnetic material from the magnetic material and separating the two materials. Additional agitation is effected by the placement of cleats on the conveyor belt which assist movement of the magnetic material through the magnetic fields.

In a preferred construction of the first embodiment, the series of magnets is comprised of a first magnet which is a large circular electromagnet, a side-by-side arrangement of two smaller circular electromagnets and a final substantially rectangular electromagnet. In this arrangement, material is first attracted by the large circular magnet and is thereafter urged into the attractive field of the smaller circular magnet so that the material is moved laterally as well as longitudinally in the separator, since the material is initially attracted to the separator's longitudinal axis by the large circular magnet and is thereafter attracted to either of the smaller circular magnets which are spaced apart from the longitudinal axis. Thereafter, the material is urged away from the smaller circular magnets and into the influence of a rectangular magnet which, once again, causes some of the material to move with a lateral as well as a longitudinal component, since the rectangular magnet is centered on a longitudinal axis of the magnetic separator.

In an exemplary construction of the second embodiment, the magnets are disposed within the drums so that magnetic material travels randomly from drum-to-drum, the random movement causing lateral as well as direct movement of the magnetic material between the drums. This movement increases agitation and encourages the separation of magnetic and non-magnetic material which are initially intermixed.

In a preferred construction of the second embodiment, three rotatable drums are employed. The first and third drum each contain a single electromagnet positioned along a longitudinal axis, while the second drum contains a pair of electromagnets situated on either side of the longitudinal axis. As material is delivered by a supply conveyor, magnetic material is attracted to the surface of the first drum adjacent to the electromagnets, it is then carried around the drum and is attracted to the surface of the second drum at two points adjacent the electromagnet located therewithin, and it is thereafter carried around that drum and is attracted to the surface of the third drum at a point adjacent the electromagnet situated therewithin. Upon rotation of this third drum, the magnetic material which is attracted thereto is carried around the drum and is deposited on a chute to be carried away. Non-magnetic material which is not attracted to the drums, or which is dislodged from the magnetic material by the agitation created by the movement of the magnetic material between the drums, is allowed to fall back to the supply conveyor and thereafter be deposited in a non-magnetic material discharge zone.

Further features and advantages of the invention will readily be apparent from the following specification taken in conjunction with the accompanying drawings.

BRIEF DESCRIPTION OF THE DRAWINGS

FIG. 1 is a side elevation, partially in section, of one embodiment of the magnetic separator of the present invention illustrating the positioning of the supply conveyor;

FIG. 2 is an end elevation of the magnetic separator of FIG. 1;

FIG. 3 is a bottom elevation of the magnets employed in the magnetic separator of FIG. 1 showing their configuration and arrangement;

DESCRIPTION OF THE PREFERRED EMBODIMENT

Figure 4:
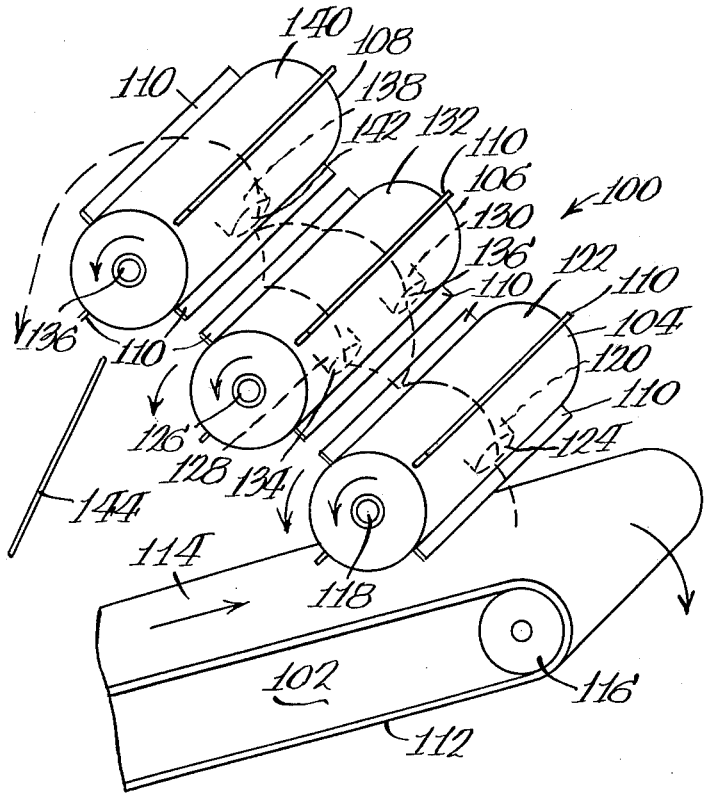
FIG. 4 is a perspective view of an alternative embodiment of the present invention.

A first embodiment of the magnetic separator constructed in accordance with the present invention is shown in FIGS. 1–3. The magnetic separator, generally designated 10, is basically comprised of a continuous transport conveyor belt 12 having a lower run 14, which extends longitudinally within the separator 10, a series of magnets 16, 18, 20 and 22 positioned closely above the lower run 14, and a supply conveyor, generally designated 24, situated below and spanned by the conveyor belt 12.

Spaced along the belt 12 and fastened thereto are laterally extending cleats 26 which are outwardly depending from the conveyor belt 12. The conveyor belt 12 is supported by a downstream drive pulley 28, an upstream idler pulley 30, and a take-up pulley 32 situated above the idler pulley 30. This arrangement of pulleys causes the conveyor belt 12, when driven, to be moved around the pulleys and past the magnets 16, 18, 20 and 22, the lower run 14 of the conveyor sloping downwardly and away from the supply conveyor 24. However, the tension applied to the conveyor belt 12 may be varied whereby the lower run 14 has a catenary suspension so that stress on the conveyor belt 12 is reduced. The pulleys 28, 30 and 32 are rotatably mounted to a frame (not fully shown) which includes a frame member 34 for supporting the drive pulley 28 at one end thereof, a frame member 36 for supporting the idler pulley 30, and a frame member 38 for supporting the take-up pulley 32. Enclosing the drive pulley 28 and one end of the conveyor belt 12 is a removable safety guard 40 and enclosing the idler pulley 30, the take-up pulley 32 and the opposing end of the conveyor belt 12 is another removable safety guard 42. A motor 44 in connection with a variable pitch sheave 46 powers a belt 48 driving the drive pulley 28 through a shaft mounted reducer 50.

The supply conveyor 24 includes a belt 52 having an upper run 54 which carries a mixture of magnetic and non-magnetic material therealong toward a downstream end of the supply conveyor supported by a pulley 56. The downstream end of the conveyor 24 is positioned in proximity with the magnet 16 which is the first magnet in the series. The lower run 14 of the conveyor 24 moves in a direction coinciding with the movement of the upper run 54 of the supply conveyor 24.

The series of magnets 16, 18, 20 and 22 is substantially longitudinally coextensive with the lower run 14 and generates a series of adjacently disposed confining magnetic fields which cause magnetic material to be held in suspension underneath. The magnets 16, 18, 20 and 22 in the lower run 14 are so disposed that the magnets 16 and 22 are situated on a longitudinal axis extending therethrough and the magnets 18 and 20 are oppositely situated laterally on either side of that longitudinal axis. The first magnet in the series is a large circular electromagnet 16 having a core 58, windings 60, and a housing 62. The flux intensity of electromagnet 16 is such that magnetic material is attracted from the belt 52 to the belt 12.

Longitudinally next in the series are similar laterally adjacent circular electromagnets 18 and 20 having cores 64 and 66, windings 68 and 70, and housings 72 and 74, respectively. Last in the series is a substantially rectangular electromagnet 22 having a core 76, windings 78, and a housing 80. The outer edges of the core 76 line up substantially with the midportions of the cores 64,66.

The magnets 16, 18, 20 and 22 are of such intensity that a series of magnetic fields is generated which encompasses substantially all of the lower run 14 extending from a position opposite the supply conveyor 24 to a magnetic material discharge zone near the downstream end of the run 14 at the drive pulley 28. It is to be understood that permanent magnets may be substituted for one or more of the electromagnets 16, 18, 20 or 22. That is, for instance, magnet 16 could be a circular electromagnet, as shown, and the two smaller magnets 18, 20 could be permanent magnets with the fourth magnet 22 being an electromagnet, as shown.

In operation, the supply conveyor 24 carries a mixture of magnetic and non-magnetic material to a position at the downstream end of the supply conveyor 24 within the attractive influence of the magnet 16. Magnetic material is attracted by magnet 16 to the belt 12 along the lower run 14 at a position adjacent its core 58 along the longitudinal axis. Non-magnetic material, which is not attracted or not entrapped in the magnetic material, is carried around the downstream end of the supply conveyor 24 and drops into a non-magnetic material discharge zone.

Magnetic material, which is attracted to the belt 12, is suspended beneath the belt 12 along the lower run 14 and some of said magnetic material moves with the belt while the rest tends to remain adjacent the core 58 until one of the cleats 26 moves into contact with the magnetic material and urges it to move along with the circulating belt 12. As the material moves out of the influence of the magnet 16, it enters the field of influence generated by the magnets 18 and 20. At the boundary of the fields 18 and 20, the magnetic material does not fall, since it is constantly in a magnetic field by which it is maintained in suspension below the belt 12 and in contact therewith along the lower run 14. It is then snapped or randomly moved or attractively drawn to the cores 64, 66, which are spaced from the central axis of the belt 12, in advance of the movement of the cleats 26. Some of the material will be drawn to the core 64, while some will be drawn to the core 66. Not only will this arrangement of the magnets 18 and 20 cause lateral movement of the material across the belt 12, but the attractive influence will cause material to be attracted to the cores 64 and 66 prior to the advance of the cleats 26 to the magnets 18 and 20. This action will cause gyration and agitation of the material so that any non-magnetic material entrapped within the attracted material will be dislodged and thereby fall from the belt 12 into the non-magnetic material discharge zone. Additional agitation is caused by the action of the cleats 26 moving the material thereto.

As the belt 12 advances, one of the cleats will contact material held at the cores 64 and 66 and urge the material to move along with the belt 12 and gradually out of the influence of the magnets 18 and 20. Continued advancement of the belt 12 will cause the material to enter the influence of the magnet 22, the last magnet in series. At this point, the material will move or snap forward and some will move slightly laterally to a position adjacent the elongate core 76 near the longitudinal axis. This movement and the action of the cleats causes gyration and agitation of the attracted material which tends to dislodge any non-magnetic material still trapped therein. This non-magnetic material falls out of contact with the belt 12. As the belt 12 advances to the core 76 of the magnet 22, one of the cleats 26 will, once again, contact the material residing in contact with the belt 12 and urge it along with the belt 12 and out of the influence of magnet 22.

At the conclusion of the operation, magnetic material will have been transported to a point on the belt 12 near the driving pulley 28 and it will be substantially free of any entrapped non-magnetic material. Because of the confining magnetic field generated by the series of electromagnets, the material is held continually in suspension below the lower run 14. At this point near the pulley 28, the magnetic material leaves the confining magnetic fields that held it against the belt 12 and falls into a magnetic material discharge zone.

It is to be understood that the system works effectively using only the large initial magnet 16 and the two side-by-side magnets 18 and 20. Also, additional magnets, i.e. four or more, can be added to the series so as to meet specific requirements without departing from the spirit of the invention. The sizes and shapes of the respective magnets 16, 18, 20 and 22 may be varied to meet various requirements. The specific orientation and shapes of the magnets 16, 18, 20 and 22, described above, have produced a highly efficient separator which yield a magnetic product virtually clean of loose non-magnetic materials.

Figure 5:
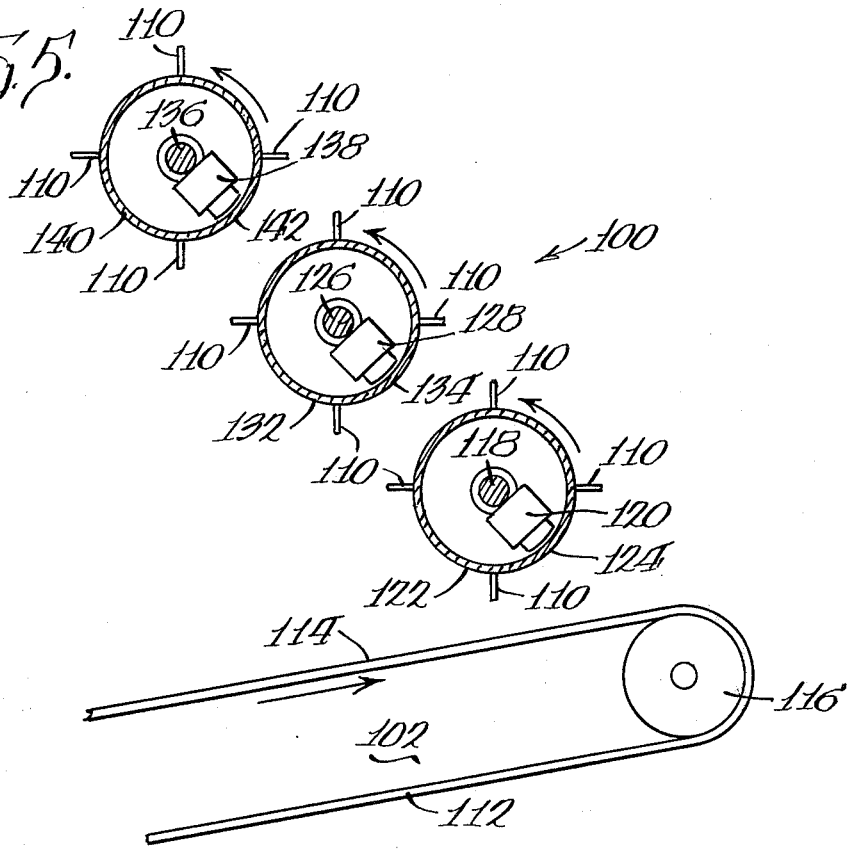
FIG. 5 is a sectional side elevation of FIG. 4.

An alternative embodiment of a magnetic separator made in accordance with the present invention is illustrated in FIGS. 4 and 5. The magnetic separator, generally designated 100, includes a supply conveyor, generally designated 102, and a series of rotatable hollow cylindrical transport drums 104, 106 and 108 in spaced linear relationship, each of which spans the lateral width of the conveyor 102. Each of the drums 104, 106 and 108 has at least one electromagnet disposed within its hollow interior. Each of the drums 104, 106 and 108 has a series of laterally extending cleats 110 which are disposed on the outside surface of each of the drums 104, 106 and 108 and extend radially outward therefrom.

In the preferred construction of this alternative embodiment, the drums 104, 106 and 108 are situated above the supply conveyor 102 and are arranged in a configuration such that each drum is mounted upwardly and rearwardly of the downstream drum. The drums 104, 106 and 108 are disposed laterally across a longitudinal axis extending through the center of the supply conveyor 102 and the center of the drums 104, 106 and 108.

The supply conveyor 102 consists of a belt 112 having an upper run 114 and a pulley 116 at the downstream end around which the belt 112 travels. The drum 104 is located upstream of the downstream end of the supply conveyor 102 and spaced vertically thereabove to permit passage of a mixture of magnetic and non-magnetic material to be separated along the upper run 114 beneath the drum 104.

The drum 104 laterally spans the belt 112 and is mounted for rotational movement on an axle 118. The drum 104 rotates in a direction such that the lower portion of the drum 104 moves in a direction coinciding with the upper run 114 of the belt 112. Immovably mounted on the axle 118 along the aforementioned longitudinal axis is an electromagnet 120 so situated and having such intensity that any magnetic material traveling below the drum 104 along the top of the belt 112 is attracted to the outer surface 122 of the drum 104. The material is held on the outer surface 122 along a lower portion of the drum 104 at a position 124 adjacent the electromagnet 120. The rotation of the drum 104 causes one of the cleats 110 on the drum 104 to move into contact with the material held in suspension against the outer surface 122 so that the material is urged away from the influence of the electromagnet 120 and around to the top portion of the drum 104.

Situated above and rearwardly of the drum 104 is a similar drum 106 mounted for rotational movement on an axle 126 and rotating in the same direction as drum 104. Immovably mounted within the drum 104 and secured to the axle 126 on either side of the aforementioned longitudinal axis are two similar electromagnets 128 and 130. The magnets 128 and 130 are positioned such that they provide an attractive influence on the top portion of the downstream drum 104 and cause magnetic material which is brought to the top portion of the drum 104 to be attracted to the surface 132 along a lower portion of the drum 106 at a position 134 adjacent the magnet 128 or a position 136 adjacent magnet 130. Non-magnetic material, which may have been originally entrapped with the magnetic material on the drum 104 will not be attracted to the drum 106 and will remain on the surface of the drum 104 until the drum 104 rotates further causing the non-magnetic material to fall back onto the belt 112. Because two magnets are employed within the drum 106, material will have a lateral as well as an upward and rearward movement which tends to agitate and gyrate the material as it travels between the drum 104 and the drum 106 so that non-magnetic material entrapped within magnetic material is allowed to fall away from the drum 106. The rotation of the drum 106 causes one of the cleats 110 to move into contact with the material held against the surface 132 and urge the material away from the electromagnets 128 and 130 out of their influence and around to the top portion of the drum 106.

The drum 108 also residing above and rearwardly of the similar downstream drums 104 and 106 and in substantial linear relationship therewith is mounted for rotational movement on an axle 136 and rotates in the same direction as drums 104 and 106. Immovably secured to the axle 136 alaong the aforementioned longitudinal axis, is an electromagnet 138 which is positioned such that the electromagnet 138 has an attractive influence on the top portion of the downstream drum 106 and causes magnetic material which is brought to the top portion of the drum 106 to be attracted to and held on the surface 140 along a lower portion of the drum 108 at a position 142 adjacent the magnet 138. Non-magnetic material which may have still been entrapped within the magnetic material in the drum 106 will not be attracted and will, upon continued rotation of the drum 106, fall back onto the belt 112. Rotation of the drum 108 causes one of the cleats 110 to move into contact with the material, force it around the opposite side of the drum 108 causing it to fall onto the chute 144. Since the final drum 108 has a single electromagnet 138, the material drawn from the drum 106 has a lateral as well as an upward and rearward movement which tends to agitate and gyrate the material as it travels between drums 106 and 108 so as to dislodge non-magnetic material which may be entrapped within the magnetic material. This non-magnetic material is allowed to fall back onto the conveyor 102.

Thus, it can be seen that non-magnetic material will be carried beyond the supply conveyor 102 and into a non-magnetic discharge zone and that magnetic material will be moved upwardly and rearwardly from the conveyor 102 and onto a chute 144 or magnetic material discharge zone substantially free of non-magnetic material. The electromagnets provide a confining magnetic field of such intensity that magnetic material is held against the surfaces of the drums 104, 106, 108 and is not allowed to fall back on the conveyor 102. As a result, all magnetic material is transported to the magnetic material discharge zone and is not allowed to fall onto the conveyor and mix with the non-magnetic material. If by circumstance magnetic material is dislodged from any of the drums, 104, 106 and 108, it will fall back onto the conveyor 102 upstream of the pick-up station. As it passes again under the drum 104, it will be attracted back onto the first drum 104. Note that a reverse configuration of the drums, one that is arranged upwardly and forwardly, would permit magnetic material, if it becomes dislodged, to fall into an area in which non-magnetic material is being finally discarded.

It can be seen that this embodiment illustrates a method wherein the material being attracted by the magnets is not held against any one surface for any substantial length of time, but rather is transferred from one surface to another such that any material which is not subject to an attractive force is allowed to fall away from the drums which provide transportation solely for magnetic material.

The magnets 120, 128 and 138 are described as electromagnets, but they may be permanent magnets. That is, one or more of the magnets in various combinations may be permanent and electro magnets and will result in an efficient and effective separator.

I claim:

1. A magnetic separator for extracting magnetic material from a mixture of magnetic and non-magnetic material comprising:

a non-magnetic material discharge zone;

a magnetic material discharge zone spaced from said non-magnetic discharge zone;

a plurality of magnets generating a series of longitudinally adjacent rows of magnetic fields, each row in said series being generated by at least one magnet, each of said magnets having a core towards which said magnetic material is attracted;

means for supplying said mixture at a position within the first row of magnetic fields in said series whereby said magnetic material within said mixture is attracted by the magnetic fields of said first row;

at least one of said magnets having a core disposed along a longitudinal axis spanning substantially between said supply means and said magnetic material discharge zone, the remainder of said magnets having cores spaced laterally of said longitudinal axis, each of said cores defining a path of a width equal to the width of the core, none of the paths generated by at least one row of magnets in said series passing through a core in each row of said series; and means extending between longitudinally adjacent rows of magnetic fields for transporting said magnetic material from one row of magnetic fields in said series to the next row of magnetic fields in said series, said transporting means being situated intermediate said magnetic material and said magnets so that said magnetic material is attracted to and held in contact with said transporting means, said transporting means also transporting said magnetic material from the last magnetic field in said series to said magnetic material discharge zone, said magnetic fields being of such strength and said transporting means being so disposed relative to said magnetic fields whereby said magnetic material is agitatedly transported longitudinally and laterally from said first row of magnetic fields to said magnetic material discharge zone so that said non-magnetic material entrapped in said magnetic material is discarded in said non-magnetic material discharge zone and said magnetic material is released in said magnetic material discharge zone free of non-magnetic material.

2. The magnetic separator of claim 1 wherein each of said magnets spaced laterally of said axis has a corresponding magnet disposed on the opposite side of said longitudinal axis.

3. The magnetic separator of claim 2 wherein said corresponding magnets are substantially identical.

4. The magnetic separator of claim 1 wherein the first row in said series is generated by a single circular magnet, said first row is longitudinally followed by a row of laterally adjacent fields generated by a pair of circular magnets, and the last row in said series is generated by a single, substantially rectangular magnet.

5. The magnetic separator of claim 4 wherein said transporting means is a continuous belt having an upper and a lower run, said lower run spanning between said supply means and said magnetic discharge zone, said magnets being disposed between said upper and lower runs, said magnetic material being suspended underneath the lower run by the action of said magnetic fields, said magnetic fields being contiguous so that said magnetic material is transported within a magnetic field until released in said magnetic material discharge zone.

6. The magnetic separator of claim 1 wherein said transporting means is a continuous belt having an upper and a lower run, said lower run spanning between said supply means and said magnetic material discharge zone, said magnets being disposed between said upper and lower runs, said magnetic material being suspended underneath the lower run by the action of said magnetic fields, said magnetic fields being contiguous so that said magnetic material is transported within a magnetic field until released in said magnetic material discharge zone.

7. A magnetic separator for extracting magnetic material from a mixture of magnetic and non-magnetic material comprising:

a non-magnetic material discharge zone;

a magnetic material discharge zone spaced from said non-magnetic discharge zone;

a plurality of magnets generating a series of longitudinally adjacent rows of magnetic fields, each row in said series being generated by at least one magnet, each of said magnets having a core towards which said magnetic material is attracted;

means for supplying said mixture at a position within the first row of magnetic fields in said series whereby said magnetic material within said mixture is attracted by the magnetic fields of said first row;

a portion of said magnets having cores disposed along a longitudinal axis spanning substantially between said supply means and said magnetic material discharge zone, the remainder of said magnets having cores spaced laterally of said longitudinal axis, each of said cores defining a path of equal width thereto extending longitudinally through said series of magnetic fields, none of the paths generated by at least one row of magnets in said series passing through a core in each row of said series; and means extending between longitudinally adjacent rows of magnetic fields for transporting said magnetic material from one row of magnetic fields in said series to the next row of magnetic fields in said series, said transporting means being comprised of a series of drums, each of said drums having a rotating surface and having interior portions adapted to receive at least one of said magnets, the first drum in said series having at least one associated magnet generating a magnetic field acting on a portion of said supply means, each of the remaining drums in said series having at least one associated magnet generating a magnetic field acting on a portion of the surface of the preceding drum in said series, each of said magnets thereby causing magnetic material to be drawn to and held against the surface of its associated drum, said drums also transporting said magnetic material from the last magnetic field in said series to said magnetic material discharge zone, said magnetic fields being of such strength and said drums being so disposed relative to said magnetic fields whereby said magnetic material is agitatedly transported longitudinally and laterally from said first row of magnetic fields to said magnetic discharge zone so that said non-magnetic material entrapped in said magnetic material is discarded in said non-magnetic material discharge zone and said magnetic material is released in said magnetic material discharge zone free of non-magnetic material.

8. The magnetic separator of claim 7 wherein said longitudinal axis is inclined relative to horizontal, said series of drums being disposed laterally across said longitudinal axis so that said first drum is lowermost and the remainder of said drums are positioned thereabove, said supply means being positioned below said first drum.

9. The magnetic separator of claim 8 wherein said magnets are positioned in each of said drums so that said magnetic material is attracted to said surface on a lower portion of its associated drum, the rotation of said drum causing said magnetic material to be transported along said surface to an upper portion of said drum, said magnetic material thereat being attracted to the succeeding drum in said series, the rotation of the last drum in said series causing said magnetic material to be released into said magnetic material discharge zone.

10. The magnetic separator of claim 7 wherein said series of drums is disposed so that material discarded after being attracted to said drums is returned to a position on said supplying means whereby it is redelivered to a position within the magnetic field associated with said first drum.

11. The magnetic separator of claim 7 wherein at least two of said drums have a single magnet disposed along said longitudinal axis.

12. The magnetic separator of claim 7 wherein at least one of said drums has a plurality of magnets, said plurality of magnets being disposed laterally on either side of said longitudinal axis.

13. The magnetic separator of claim 12 wherein said plurality of magnets is a pair of magnets disposed on either side of said longitudinal axis.

14. A magnetic separator for extracting magnetic material from a mixture of magnetic and non-magnetic material comprising:

a non-magnetic material discharge zone;

a magnetic material discharge zone spaced from said non-magnetic material discharge zone;

a plurality of magnets, each magnet having a core towards which said magnetic material is attracted;

a series of drums, each of said drums having a rotating surface and having an interior portion receiving at least one of said magnets, each of said magnets generating an associated magnetic field extending beyond the surface of said drum, said magnetic fields generally defining a longitudinal series of magnetic fields, each core defining a path of equal width thereto extending longitudinally through said series of magnetic fields, none of the paths generated by at least one row of magnets in said series passing through a core in each element of said series;

means for supplying said mixture at a position within a magnetic field associated with the first drum in said series so that said magnetic material and some entrapped non-magnetic material within said mixture is attracted to and held against the surface of said first drum, the non-entrapped non-magnetic material thereafter being transported to said non-magnetic material discharge zone; and each of the succeeding drums in said series situated so that its associated magnetic field acts on a portion of the surface of the preceding drum, the rotation of each of the preceding drums in said series causing magnetic material held against its surface to be transported into the magnetic field of the succeeding drum in said series so that said magnetic material is attracted to and held against the surface of the succeeding drum in said series, the rotation of the last drum in said series transporting said magnetic material to said magnetic material discharge zone, whereby magnetic material is agitatedly transported longitudinally and laterally from said supplying means to said magnetic material discharge zone.

15. The magnetic separator of claim 14 wherein at least one of the drums in said series has more than one magnet.

16. The magnetic separator of claim 15 wherein at least one of the drums in said series has a pair of magnets.

17. The magnetic separator of claim 16 wherein at least two of the drums in said series have a single magnet.

18. The magnetic separator of claim 17 wherein said single magnets are disposed along a longitudinal axis extending substantially between said supplying means and said magnetic material discharge zone.

19. The magnetic separator of claim 18 wherein the magnets of said pair of magnets are oppositely disposed laterally of said longitudinal axis.

20. The magnetic separator of claim 14 wherein said series of drums are disposed relative to said supply means so that material initially attracted to said drums and discarded before being transported to said magnetic material discharge zone is returned to said supply means and is thereafter returned to a position within the magnetic field associated with said first drum.

21. The magnetic separator of claim 20 wherein said supply means is situated below said series of drums.

22. The magnetic separator of claim 21 wherein said series of drums are in a substantially linear arrangement along a line inclined relative to the horizontal, said series of drums being situated so that said mixture is being delivered in one direction and said magnetic material is transported in a substantially opposite direction.

23. The magnetic separator of claim 22 wherein said supply means is a conveyor.

* * * * *